US010598179B2

(12) United States Patent
Burnham et al.

(10) Patent No.: US 10,598,179 B2
(45) Date of Patent: Mar. 24, 2020

(54) METHODS AND SYSTEMS TO DETECT AN OPERATION CONDITION OF A COMPRESSOR

(71) Applicant: THERMO KING CORPORATION, Minneapolis, MN (US)

(72) Inventors: Randy Scott Burnham, Maple Grove, MN (US); David Jon Renken, Prior Lake, MN (US); Erich Albert Lucht, Arden Hills, MN (US); Cullen Evan Hall, Savage, MN (US)

(73) Assignee: Thermo King Corporation, Minneapolis, MN (US)

( * ) Notice: Subject to any disclaimer, the term of this patent is extended or adjusted under 35 U.S.C. 154(b) by 643 days.

(21) Appl. No.: 14/432,407

(22) PCT Filed: Oct. 1, 2013

(86) PCT No.: PCT/US2013/062877

§ 371 (c)(1),
(2) Date: Mar. 30, 2015

(87) PCT Pub. No.: WO2014/055524

PCT Pub. Date: Apr. 10, 2014

(65) Prior Publication Data

US 2015/0252805 A1 Sep. 10, 2015

Related U.S. Application Data

(60) Provisional application No. 61/708,338, filed on Oct. 1, 2012.

(51) Int. Cl.
*F04C 28/08* (2006.01)
*F04C 18/02* (2006.01)
(Continued)

(52) U.S. Cl.
CPC ..... *F04C 28/08* (2013.01); *F04B 49/06* (2013.01); *F04B 49/10* (2013.01); *F04B 51/00* (2013.01);
(Continued)

(58) Field of Classification Search
CPC ..... F04B 49/06; F04B 49/10; F04B 51/00; F04B 2203/0209; F04C 28/08;
(Continued)

(56) References Cited

U.S. PATENT DOCUMENTS 4,132,086 A 1/1979 Kountz
4,496,286 A 1/1985 Gagnon
(Continued)

FOREIGN PATENT DOCUMENTS

EP 1790921 5/2007
EP 1790921 A1 * 5/2007 ..... B60H 1/00014
(Continued)

OTHER PUBLICATIONS

English Translation of the Specification for JP 2005-065449.*
(Continued)

*Primary Examiner* — Dominick L Plakkoottam
*Assistant Examiner* — Connor J Tremarche
(74) *Attorney, Agent, or Firm* — Hamre, Schumann, Mueller & Larson, P.C.

(57) ABSTRACT

Embodiments to help detect operation conditions of a compressor of a TRU in real time by a genset are disclosed. The operation conditions of the compressor can be determined by monitoring a parameter pattern of the genset, such as value changes of a horsepower, a torque, an exhaust temperature, fuel consumption and/or a RPM of a prime mover of the genset, or a current drawn from a generator of the genset, over a period of time. In one embodiment, when a scroll compressor is used in the TRU, the scroll compressor
(Continued)

may start a periodical load/unload duty cycle when the TRU reaches its setpoint. The periodical load/unload duty cycle of the scroll compressor can be detected based on a corresponding fluctuation pattern in genset parameters. When this periodically fluctuating pattern of ECU parameters and/or current drawn is detected, the prime mover can be switched to a low operation speed.

20 Claims, 3 Drawing Sheets

(51) Int. Cl.
*F04C 28/28* (2006.01)
*F04B 49/10* (2006.01)
*F04B 49/06* (2006.01)
*F04B 51/00* (2006.01)

(52) U.S. Cl.
CPC ..... *F04C 18/02* (2013.01); *F04C 28/28* (2013.01); *F04B 2203/0209* (2013.01); *F04C 2270/80* (2013.01); *F04C 2270/86* (2013.01)

(58) Field of Classification Search
CPC ..... F04C 18/02; F04C 28/28; F04C 2270/80; F04C 2270/86
USPC ..... 417/411
See application file for complete search history.

(56) References Cited

U.S. PATENT DOCUMENTS 4,976,589 A 12/1990 Ide
5,197,670 A * 3/1993 Hanson ..... B60H 1/00014 165/257
5,503,134 A * 4/1996 Delosh ..... F02D 41/04 123/687
5,557,938 A * 9/1996 Hanson ..... B60H 1/3208 62/126
5,924,296 A 7/1999 Takano et al.
6,226,998 B1 * 5/2001 Reason ..... B60H 1/3208 62/228.4
7,025,572 B2 4/2006 Miyagawa et al.
7,606,639 B2 * 10/2009 Miyaji ..... G01R 22/063 307/39
7,815,423 B2 * 10/2010 Guo ..... F04C 18/0215 418/55.1
2006/0042278 A1 * 3/2006 Ludwig ..... G01K 15/00 62/130
2008/0087029 A1 * 4/2008 Renken ..... B60H 1/3222 62/134
2009/0260375 A1 10/2009 Miyazaki et al.
2009/0299534 A1 12/2009 Ludwig
2010/0175401 A1 7/2010 Taguchi et al.
2011/0110791 A1 5/2011 Donnat et al.
2011/0219797 A1 9/2011 Taguchi
2011/0247350 A1 * 10/2011 Awwad ..... F25B 27/00 62/115

FOREIGN PATENT DOCUMENTS

JP 2005064449 A * 3/2005
JP 2005065449 3/2005

OTHER PUBLICATIONS

International Search Report and Written Opinion for International Application No. PCT/US2013/062877, dated Feb. 6, 2014, 9 pgs.
Chinese Office Action issued in corresponding Chinese Application No. 201380051224.9 dated Oct. 19, 2016 (11 pages).

* cited by examiner

METHODS AND SYSTEMS TO DETECT AN OPERATION CONDITION OF A COMPRESSOR

FIELD OF TECHNOLOGY

The embodiments disclosed here generally relate to a transport refrigeration system (TRS). More specifically, the embodiments disclosed here relate to methods and systems to detect operation conditions of a compressor of the TRS so as to control operation of a generator set (genset) configured to provide power to the compressor, based on the operation condition of the compressor.

BACKGROUND

Existing TRSs are used to cool containers, trailers, railway cars and other similar transport units. When cargo in the container includes perishable products (e.g., food product, flowers, etc.), the temperature of the container may be controlled to limit loss of the cargo during shipment.

The TRS generally includes a transport refrigeration unit (TRU), which typically includes a compressor, a condenser, an evaporator and an expansion device. Some existing transport containers may also include a genset that supplies power to the TRU. These gensets typically include a prime mover to drive a generator so as to provide electrical power to the TRU. Operating the prime mover generally requires fuel and can produce noise.

The gensets may operate at a single, relatively constant speed to produce a relatively constant output frequency and/or output voltage (e.g., ~230/460 VAC, etc.). Some gensets may be configured to be operated at different speeds so as to provide a variable output frequency and/or voltage, and the operation speeds of the gensets may be chosen during the operation of the TRS.

SUMMARY

Embodiments of a TRS that help detect an operation condition of a compressor (or a motor of the compressor) of the TRS based on an operation parameter pattern of a genset of the TRS configured to provide power to the compressor are disclosed.

The genset generally includes a prime mover and a generator that is coupled to the prime mover. The operation condition of the compressor (or the motor of the compressor) may be determined based on an operation parameter pattern of the genset. The operation condition of the compressor of the TRS can be used to control the operation of the genset, such as determining an operation speed of a prime mover.

In some embodiments, a method to detect operation conditions of a compressor of the TRS may include obtaining a measured operation parameter of the genset. The measured operation parameter of the genset may be measured, for example, in real time. The method may also include determining an operation parameter pattern based on the measured operation parameter over a period of time, and matching the operation parameter pattern to an association between an operation condition of the compressor and a corresponding operation parameter pattern of the genset to obtain the operation condition of the compressor. Generally, the association between a genset parameter pattern and a compressor operation condition can be established, for example, in a laboratory setting.

In some embodiments, the operation parameters of the genset may include a RPM (revolutions per minute), a horse power, a torque, fuel consumption, and/or an exhaust temperature of the prime mover, and/or a current drawn from the generator.

In some embodiments, the prime mover may be controlled by an electronic control unit, and the operation parameter of the genset may be obtained from the electronic control unit. In some embodiments, the prime mover may be equipped with a RPMRPM sensor that is configured to monitor a RPMRPM of the prime mover, and the operation parameter can be the RPM of the prime mover. In some embodiments, the genset may be equipped with a current meter that is configured to measure a current drawn from the generator of the genset, and the operation parameter is the current drawn from the generator.

In some embodiments, the compressor may be a scroll compressor, which starts a load/unload duty cycle when the TRS reaches a temperature setpoint. As a result, the genset operation parameter(s) may have a corresponding periodically fluctuating pattern when the transport refrigeration unit reaches the temperature setpoint.

In some embodiments, a method to control an operation of a prime mover of a TRS may include determining an operation condition of a compressor of the TRS based on an operation parameter pattern of a genset that is configured to supply power to the compressor, and control the operation of the genset.

In some embodiments, an operation speed of the prime mover of the genset can be determined based on the operation condition of the compressor. In some embodiments, the operation speed of the prime mover may include a high operation speed and a low operation speed. When the TRS has not reached a temperature setpoint, the prime mover may be operated at the high operation speed. When the TRS has reached a temperature setpoint, the prime mover may be operated at the low operation speed.

In some embodiments, the TRS may include a scroll compressor, and when the operation parameter of the genset has a periodically fluctuating pattern that indicates a periodical load/unload duty cycle of the compressor, the operation speed of the prime mover may be switched to or maintained at the low operation speed.

In some embodiments, a TRS may include a compressor, a genset configured to provide electrical power to the compressor, and a controller of the genset configured to monitor an operation parameter pattern of the genset to determine an operation condition of the compressor.

In some embodiments, the genset of the TRS may include a prime mover coupled to a generator, and the controller is configured to monitor the operation parameter pattern of a RPM, a horse power, a torque, fuel consumption, and/or an exhaust temperature of the prime mover, and/or a current drawn from the generator.

In some embodiments, the genset of the TRS may include a current meter configured to measure current drawn from the genset.

Other aspects of the invention will become apparent by consideration of the detailed description and accompanying drawings.

DETAILED DESCRIPTION

Figure 1:
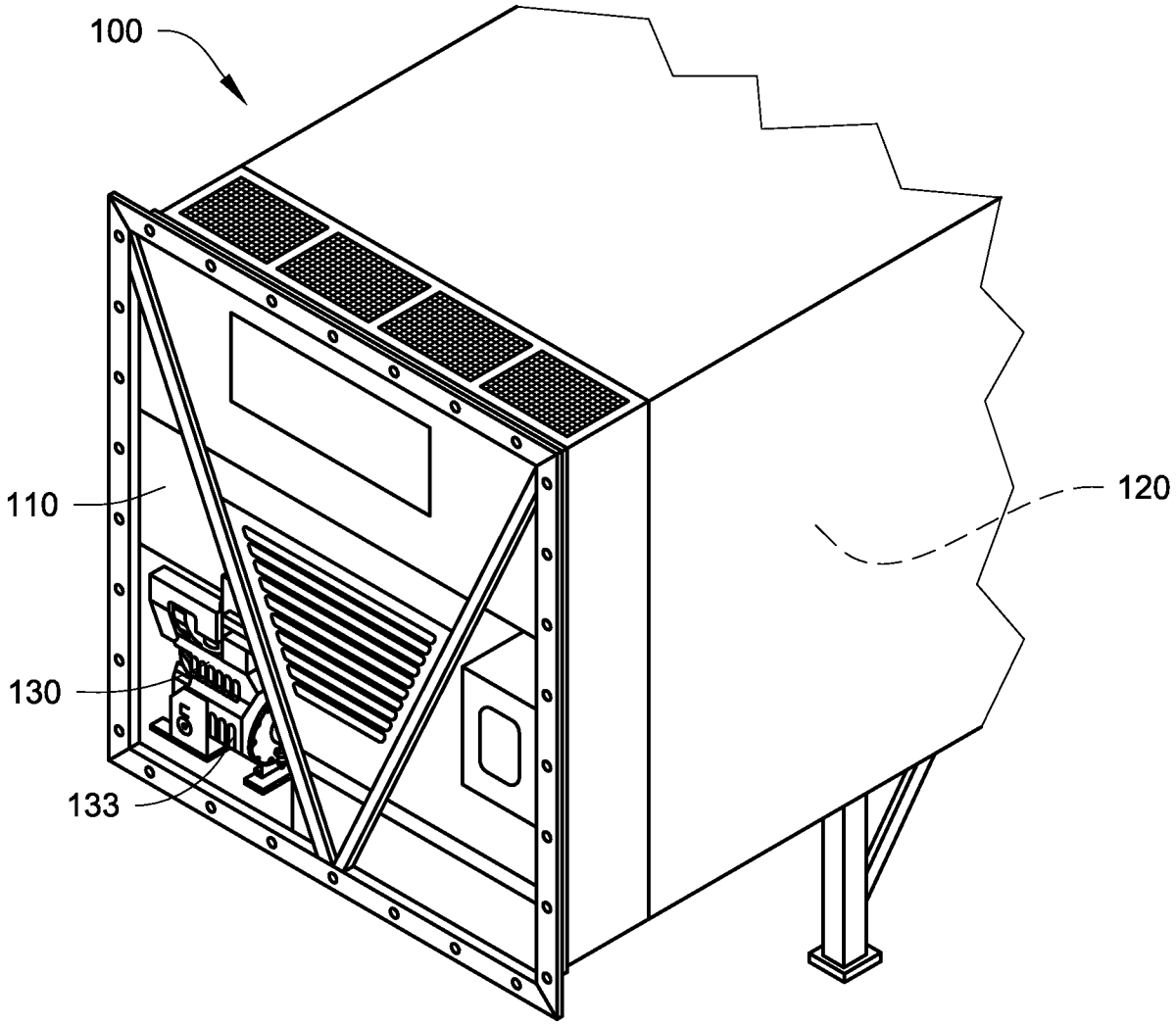
FIG. 1 is a perspective view of a temperature controlled container unit.

Some transport units, e.g. a container unit, may include a genset to supply power to a TRU. The genset generally includes a prime mover that consumes fuel and a generator driven by the prime mover to provide electrical power to, for example, a compressor of the TRU. Methods and systems that help increase a fuel efficiency of the prime mover can reduce fuel consumption and/or an environment impact (e.g. noise, carbon footprint, etc.) of the prime mover, as well as help extend the service lives of the prime mover and the TRS.

In the following description of the illustrated embodiments, embodiments to help detect operation conditions of a compressor of the TRU (such as the operation condition of the compressor when the TRU reaches a temperature setpoint) by the genset are disclosed. In some embodiments, the detection of the operation conditions of the compressor can be in real time during operation. The operation conditions of the compressor can be used to control the operations of the prime mover (e.g. operation speeds of the prime mover).

In some embodiments, when the prime mover is controlled by an electronic control unit (ECU), the operation conditions of the compressor may result in corresponding ECU parameter patterns of the prime mover. The ECU parameter patterns are referred to as patterns of parameter value changes of ECU, such as horsepower, torque, exhaust temperatures, and/or RPM of the prime mover, etc. over a period of time, which may occur due to operation conditions of the compressor change. It is to be appreciated that the ECU parameters are not limited to the parameters as listed herein. The ECU parameter patterns can be, for example, monitored by an electronic control unit (ECU) and/or a genset controller.

In one embodiment, when a scroll compressor is used in the TRU, the scroll compressor may start a periodical load/unload duty cycle when the TRU reaches its setpoint. The periodical load/unload duty cycle of the scroll compressor can be detected by the ECU and/or a genset controller based on a corresponding periodically fluctuating pattern in ECU parameters such as horsepower, torque, exhaust temperatures, and/or RPM of the prime mover. The periodical load/unload duty cycle of the scroll compressor can also be detected based on a periodically fluctuating current drawn pattern from the generator. A method to control the compressor may include when this periodically fluctuating pattern of ECU parameters and/or current drawn is detected, which generally indicates that the temperature setpoint of TRU is reached, the prime mover can be switched to a low operation speed.

References are made to the accompanying drawings that form a part hereof, and in which is shown by way of illustration of the embodiments in which the embodiments may be practiced. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical, mechanical or electrical connections or couplings. It is to be understood that the phraseology and terminology used herein is for the purpose of description and should not be regarded as limiting.

FIG. 1 illustrates a perspective view of a temperature controlled container unit 100 with a TRU 110. The TRU 110 is disposed at an end wall of the container unit 100, and is configured to transfer heat between a cargo space 120 within the container unit 100 and the outside environment so as to control a temperature within the cargo space 120 of the container unit 100. It is to be appreciated that the TRU 110 may also be disposed at outer walls of the container unit 100.

The TRU 110 of the container unit 100 can be configured to draw power from a genset 130. The genset 130 includes a prime mover 133, which can be, for example, a diesel engine. It is to be appreciated that the TRU 110 can also be configured to draw power from other suitable power sources, such as an auxiliary power unit, an electric outlet, etc.

It will be appreciated that the embodiments described herein are not limited to container units. The embodiments described herein may be used in any other suitable temperature controlled transport unit such as, for example, a truck trailer, a ship board container, an air cargo cabin, an over the road truck cabin, etc.

Figure 2:
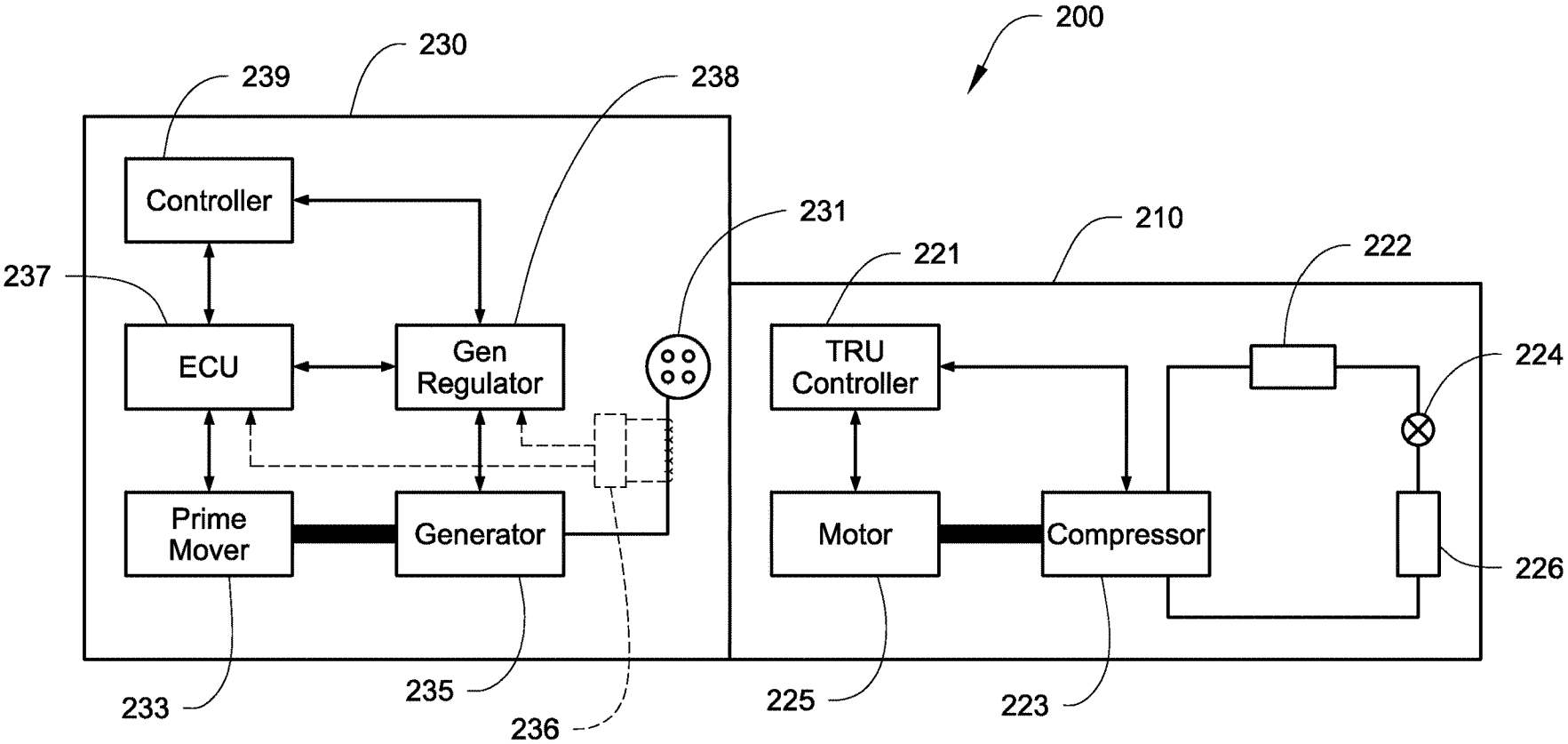
FIG. 2 illustrates a block diagram of a transport refrigeration system, according to one embodiment.

FIG. 2 illustrates a block diagram of a TRS 200 according to one embodiment. The TRS 200 includes a TRU 210 and a genset 230, which can be, for example, electrically coupled together by a power receptacle 231. The TRU 210 generally has a TRS controller 221 that is configured to control a compressor 223 and/or a motor 225 mechanically coupled to the compressor 223. The compressor 223 can form a refrigeration circuit with a condenser 222, an expansion device 224 and an evaporator 226, which can be used to regulate a temperature of a cargo space (e.g. the cargo space 120 in FIG. 1). The motor 225 can drive the compressor 223 to compress refrigerant.

The motor 225 is electronically powered by the genset 230. The genset 230 includes a prime mover 233 and a generator 235 driven by the prime mover 233. The prime mover 233 is configured to be controlled by an ECU 237, and the generator 235 is configured to be controlled by a generator regulator 238. The ECU 237 and/or the generator 235 can be configured to communicate with and/or be controlled by a genset controller 239. The ECU 237 and/or the generator regulator 238 may also be configured to communicate with each other. The genset 230 can also optionally include a current meter 236 configured to measure a current output of the generator 235.

It is to be appreciated that in some embodiments, a prime mover can be mechanically controlled, and the mechanically controlled prime mover may not include an ECU.

In operation, the TRS controller 221 is configured to have a temperature setpoint for the cargo space (e.g. the cargo space 120 in FIG. 1). In some embodiments, the temperature setpoint of the cargo space can be set to a value between about −40° Celsius to about 20° Celsius or warmer. Generally, when a temperature of the cargo space has not reached the temperature setpoint, the TRS controller 221 is configured to operate the motor 225 at about a full power (such as over 90% capacity of the motor 225), so that the compressor 223 is operated at about a full capacity accordingly. When the temperature of the cargo space is close to (such as within 2 degrees Celsius) or at the temperature setpoint, the controller 221 is configured to operate the motor 225 so that the compressor 223 can maintain the temperature of the cargo space at about the temperature setpoint, for example, 0.5 to several degrees Celsius within the temperature setpoint.

Generally, the motor 225 does not have to be operated at the full power and the compressor 223 does not have to be operated at the full capacity to maintain the temperature setpoint in the cargo space.

In some embodiments, the prime mover 233 may be a diesel engine and can be configured to have two operation speeds: a high operation speed and a low operation speed. In one embodiment, the high operation speed is about 1800 RPM and the low operation speed is about 1500 RPM. The high operation speed of the prime mover 233 is generally associated with a high power output of the generator 235, and the low operation speed of the prime mover 233 is generally associated with a low power output of the generator 233.

When the motor 225 of the TRU 221 is operated, for example, at the full power (such as when the temperature of the cargo space has not reached the temperature setpoint), it is generally desired to operate the prime mover 233 at the high operation speed so that the generator 235 can provide the high power output to meet the demand of the motor 225. When the temperature at the cargo space approaches the temperature setpoint, the motor 225 generally does not have to be operated at the full power. Accordingly, it is generally desired to operate the prime mover 233 at the low operation speed for the benefit of, for example, better fuel economy, lower operation noise and/or a longer prime mover service life in comparison to the fuel economy, the operation noise and/or the service life obtained when the prime mover 233 is operated at the high operation speed.

It is to be appreciated that the embodiment as illustrated in FIG. 2 is exemplary, and only illustrated some exemplary operation conditions of the motor of the TRU (i.e. at about full power and when the temperature setpoint has been reached). The operation conditions of the TRU can vary. Generally, for the benefit of, for example, better fuel economy, lower operation noise and/or longer service life, it is desired to change the operations of the prime mover according to operation conditions of the motor, for example, in real time. By doing so, the efficiency of the prime mover can be matched to the operation conditions of the motor, for example, in real time, so as to keep the prime mover being operated at a relative high efficiency.

Figure 3:
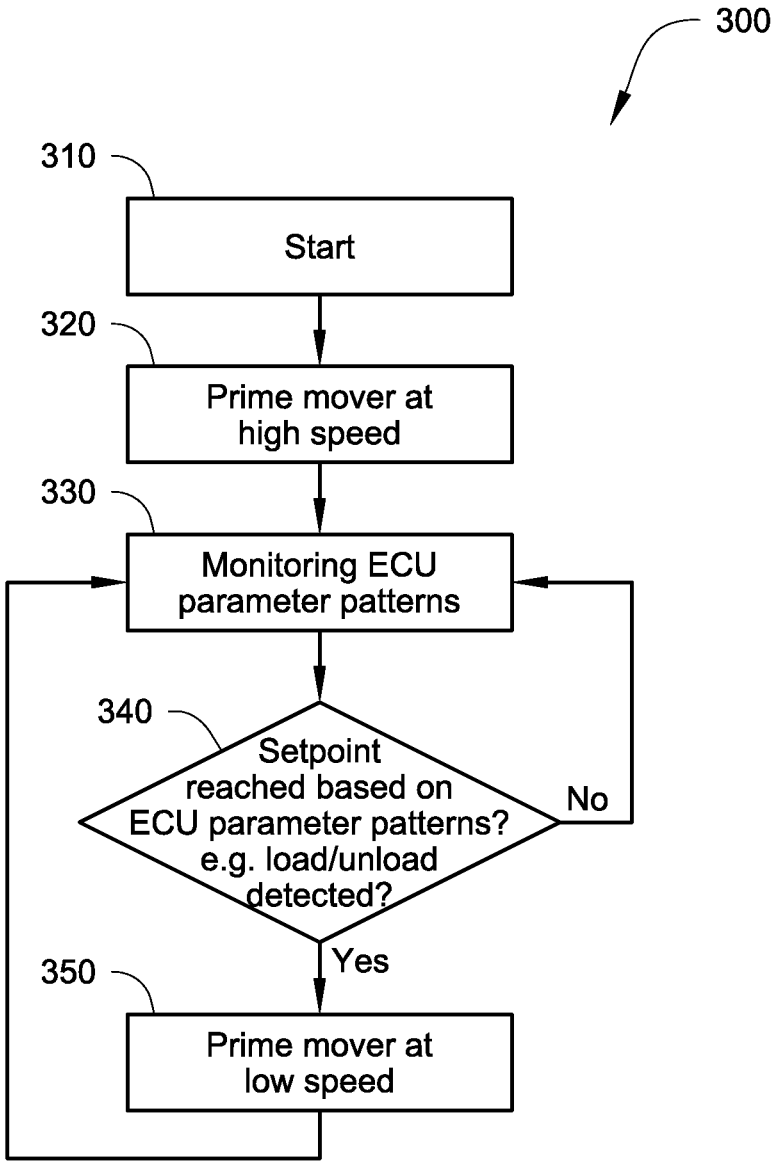
FIG. 3 illustrates a flow chart of a method to control a prime mover of a transport refrigeration system, according to one embodiment.

FIG. 3 illustrates a flow chart of an embodiment of a method 300 to detect an operation condition of a motor (e.g. the motor 225 in FIG. 2) by a genset (e.g. the genset 230 in FIG. 2), for example, in real time during operation, so that the operation speeds of the genset can be changed according to the operation condition of the motor (or the compressor driven by the motor), for example, in real time during operation.

At 310, a TRS including the genset (e.g. the genset 230 in FIG. 2) and a TRU (e.g. TRU 221 in FIG. 2) starts. Generally, when the TRS starts, the power demand of a motor (e.g. the motor 225 in FIG. 2) of the TRU is generally at about the full power so that a temperature of a cargo space can be cooled down fast. Accordingly, at 320, a prime mover (e.g. the prime mover 220 in FIG. 2) generally starts at a high operation speed (e.g. 1800 RPM) to meet the power demand of the motor.

At 330, ECU parameter patterns from an ECU (e.g. the ECU 237 in FIG. 2), such as, for example, patterns of parameter value changes in such as RPM, horse power of the prime mover, torque of the prime mover, fuel consumption, and/or a temperature of exhaust gas over a period of time, are monitored/detected. The ECU parameter patterns can be monitored/detected, for example, in real time or close to in real time during operation. The monitoring/detecting of the ECU parameter patterns can be performed, for example, by a genset controller (e.g. the genset controller 239 in FIG. 2) of the genset, with the appreciation that the ECU parameter patterns can also be obtained by other devices such as the ECU (e.g. the ECU 237 in FIG. 2) or a generator regulator (e.g. the generator regulator 238 in FIG. 2) of the genset.

At 340, the ECU parameter patterns obtained from the ECU are used to determine whether a preset operation condition of the motor has been met, such as whether the temperature in the cargo space has reached the temperature setpoint and the motor therefore no long needs full power from the prime mover, for example, in real time during operation. This can be accomplished by establishing a match between the ECU parameter patterns obtained when the TRS is in operation, for example, in real time, and a predetermined ECU parameter pattern associated with the operation condition that the temperature in the cargo space has reached the temperature setpoint.

For example, when a scroll compressor is used as the compressor in the TRU, the motor drives an orbiting scroll against a fixed scroll. Before the temperature setpoint has been reached, refrigerant is generally constantly compressed by the relative motions of the orbiting and fixed scrolls, which requires a relatively high power demand from the motor. However, when the temperature setpoint is approached or reached, the scroll compressor starts a periodical load/unload duty cycle. In the periodical load/unload duty cycle, the motor drives the orbiting scroll in a relatively constant orbiting rate. But in each load/unload duty cycle, the orbiting scroll may engage the fixed scroll for a period of time, such as about 6 to 10 seconds, to compress the refrigerant (i.e. the scroll compressor is loaded), then disengage from the fixed scroll for a period of time, such as about 6 to 10 seconds, so that virtually no refrigerant is compressed by the scrolls (i.e. the scroll compressor is unloaded). When the scroll compressor is used in the TRU, this load/unload duty cycle can be configured to, for example, maintain the temperature inside the cargo space at about the temperature setpoint. Generally, during the load/unload duty cycle, an average power demand of the motor is relatively low.

When the scroll compressor is loaded, the power demand of the motor is relatively high; while when the scroll is unloaded, the power demand of the motor is relatively low. The operation condition of the load/unload duty cycle of the motor can result in a periodically fluctuating power demand from the motor. This periodical fluctuating power demand can cause periodically fluctuating power output from the generator, which in turn results in a pattern of periodically fluctuating ECU parameters. As a result, the values of RPM, horse power of the prime mover, torque of the prime mover, fuel consumption, and/or a temperature of exhaust gas changes over a period of time can have a periodically fluctuating pattern that, for example, can have a frequency that is similar to the power output fluctuation of the generator and/or the load/unload duty cycle of the compressor. Therefore, when this periodically fluctuating pattern of the ECU parameters is detected, it generally indicates that the temperature setpoint has been reached in the TRU with the scroll compressor.

It is to be appreciated that the ECU parameters are not limited to the parameters, such as RPM, horse power of the prime mover, etc., as listed herein. Generally, any ECU parameters that may have a periodically fluctuating pattern that can be affected by the operation conditions of the compressor may be used.

At 340, if the periodically fluctuating pattern is detected, which generally indicates that the temperature setpoint is reached and the motor does not require the high power, the method 300 goes to 350, at which time the prime mover is switched to a low operation speed (e.g. 1500 RPM). The method 300 then goes back to 330 to keep monitoring the ECU parameter patterns.

At 340, if the periodically fluctuating pattern in ECU parameters is not detected, which generally indicates that the temperature setpoint has not reached, the method 300 goes back to 330 to keep monitoring the ECU parameter patterns. The prime mover is kept at (or switched to) the high operation speed so as to meet the high power demand by the motor.

It is to be noted that parameter patterns other than ECU parameter patterns can be used in 340. For example, an operational current meter (e.g. the current meter 236 in FIG. 2) can be coupled to an output wire of the generator (e.g. the generator 235 in FIG. 2). The current meter can measure a current output, for example in real time, by the generator and the values measured by the current meter can be received by, for example, the genset controller. When the temperature setpoint has been reached, which results in, for example, the scroll compressor to enter the periodical load/unload duty cycle, the genset controller in communicating with the current meter can detect that the output current from the generator fluctuates periodically in a frequency that is similar to the load/unload duty cycle of the compressor. When this periodically fluctuating current pattern is detected, the prime mover can be switched to the low operation speed.

It is to be appreciated that the prime mover can be mechanically controlled. In the mechanically controlled prime mover, a RPM sensor may be positioned, for example, on a fly wheel of the prime mover. The rpm sensor can be configured to measure a rotation speed of the fly wheel. The changes in the operation conditions of the motor may cause rotation speed changes of the fly wheel.

For example, when the scroll compressor is used, due to droop control of the mechanically controlled prime mover, the load/unload duty cycle of the scroll compressor when the temperature setpoint has been reached can result in a pattern of fluctuating fly wheel speed. This periodically fluctuating fly wheel speed can be monitored/detected by the speed sensor. Accordingly, the prime mover can be switched to the low operation speed when the pattern of the fluctuating fly wheel speed is detected.

It is to be appreciated that the method 300 described in FIG. 3 is not limited to a scroll compressor. The method can be used with TRUs using different types of compressors, such as a reciprocating compressor, a screw compressor, etc. For each different compressor, ECU parameter patterns when the temperature setpoint has been reached in the TRU can be measured. During operation, if the ECU parameter pattern monitored/detected matches the pre-measured ECU parameter patterns that generally indicate that the temperature setpoint has been reached, the prime mover can be switched to the low operation speed.

It is further to be appreciated that the method 300 described in FIG. 3 can also be adopted to control the operations of the prime mover based on other compressor (or the motor driving the compressor) operation conditions. Generally, an association between a particular genset parameter pattern and a particular compressor operation condition can be established, for example, in a laboratory setting. For example, a series of ECU parameter patterns can be established for a series of different compressor loads of the TRU. Furthermore, an optimized operation condition (e.g. the operation speeds) of the prime mover may be established for each of the different compressor loads. During operation, the ECU parameter patterns can be monitored/detected, for example in real time. If the ECU parameter pattern monitored in real time matches a specific pattern, which generally indicates that the compressor is operated at the specific load associated with the specific ECU parameter patterns, the prime mover can be operated at the operation condition optimized for the specific load. Other types of compressor operation conditions can be associated with specific ECU parameter patterns similarly.

It is to be appreciated that the ECU parameters, such as the values of RPM, horse power of the prime mover, torque of the prime mover, fuel consumption, and/or a temperature of exhaust gas changes over a period of time, and/or the current drawn from the generator, are exemplary. Other operation parameters of the genset can also be used to determine the operation condition of the compressor. Generally, any one of the operation parameters or a combination of several operation parameters of the genset that may be affected by the compressor operation condition changes can be used to monitor the operation condition of the compressor. Since the values of the operation parameter of the genset changes in accordance with the changes in the operation condition of the compressor, an association can generally be established between the operation parameter patterns of the genset and the operation conditions of the compressor. This association can then be used to determine the operation condition of the compressor based on a monitored parameter pattern of the genset.

Aspects

Any of aspects 1-9 can be combined with any of aspects 10-18. Any of aspects 10-14 can be combined with any of aspects 16-18.

Aspect 1. A method to detect an operation condition of a compressor of a transport refrigeration system comprising:

obtaining an operation parameter of a generator set, wherein the generator set includes a prime mover that is configured to drive a generator that supplies power to the compressor;

determining an operation parameter pattern based on the operation parameter over a period of time; and determining the operation condition of the compressor based on the operation parameter pattern.

Aspect 2. The method of aspect 1, wherein determining the operation condition of the compressor based on the operation parameter pattern includes matching the operation parameter pattern to an association between the operation condition of the compressor and a corresponding operation parameter pattern of the generator set.

Aspect 3. The method of aspects 1-2, wherein the operation parameter of the generator set includes at least one of a RPM (Revolutions Per Minute), a horse power, a torque, fuel consumption, and/or an exhaust temperature of the prime mover, and a current drawn from the generator.

Aspect 4. The method of aspects 1-3, wherein obtaining the operation parameter of a generator set include obtaining the operation parameter of the generator set from an electronic control unit of the prime mover.

Aspect 5. The method of aspects 1-4 further comprising, controlling the prime mover of the generator set according to the operation condition of the compressor.

Aspect 6. The method of aspects 1-5, wherein the operation parameter is a RPM of the prime mover, and obtaining the operation parameter of the generator set including obtaining a RPM of the prime move from a RPM sensor that is configured to monitor a RPM of the prime mover.

Aspect 7. The method of aspects 1-6, wherein the compressor is a scroll compressor, the operation condition is when the transport refrigeration unit approaches a temperature setpoint, the operation parameter of the generator set includes at least one of the a RPM, a horse power, a torque, fuel consumption, and an exhaust temperature of the prime mover, and/or a current drawn from the generator.

Aspect 8. The method of aspects 2-7, wherein matching the operation parameter pattern to the association between the operation condition of the compressor and the corresponding operation parameter pattern of the generator set includes:

determining that the operation condition of the compressor is that the compressor reaches a temperature setpoint when the operation parameter pattern has a periodically fluctuating pattern.

Aspect 9. The method of aspects 2-8, wherein matching the operation parameter pattern to the association between the operation condition of the compressor and the corresponding operation parameter pattern of the generator set includes:

determining that the operation condition of the compressor is when the transport refrigeration unit approaches the temperature setpoint when the real time operation parameter pattern of the prime mover has a frequency similar to a periodical load/unload duty cycle of the compressor.

Aspect 10. A method to control an operation of a prime mover of a transport refrigeration system comprising:

determining an operation condition of a compressor of the transport refrigeration system based on an operation parameter of a generator set that is configured to supply power to the compressor, wherein the generator set includes a prime mover coupled to a generator;

determining an operation speed of the prime mover based on the operation condition of the compressor; and operating the prime mover at the operation speed.

Aspect 11. The method of aspect 10, wherein the operation speed of the prime mover includes a high operation speed and a low operation speed.

Aspect 12. The method of aspects 10-11, determining the operation speed of the prime mover includes determining the operation speed of the prime mover to be the high operation speed when the transport refrigeration system has not approached a temperature setpoint.

Aspect 13. The method of aspects 11-12, determining the operation speed of the prime mover includes determining the operation speed of the prime mover to be the low operation speed when the transport refrigeration system has approached a temperature setpoint.

Aspect 14. The method of aspects 10-13, wherein the operation parameter of the generator includes at least one of a RPM (Revolutions Per Minute), a horse power, a torque, fuel consumption, and/or an exhaust temperature of the prime mover, and a current drawn from the generator.

Aspect 15. The method of aspect 14, wherein the compressor is a scroll compressor, the operation speed of the prime mover has a high operation speed and a low operation speed, and the operation condition of the compressor is a periodical load/unload duty cycle, the determining the operation condition of the compressor of the transport refrigeration system based on the operation parameter of the generator set includes determining whether the operation parameter has a periodically fluctuating pattern that has a frequency that is similar to the periodical load/unload duty cycle, and the determining the operation speed of the prime mover based on the operation condition of the compressor includes determining the operation speed to be the low operation speed if the periodically fluctuating pattern is determined.

Aspect 16. A transport refrigeration system comprising:

a compressor;

a generator set configured to provide electrical power to the compressor; and a controller of the generator set configured to monitor a parameter pattern of the generator set to determine an operation condition of the compressor.

Aspect 17. The transport refrigeration system of aspect 16, wherein the generator set includes a prime mover and a generator, and the controller is configured to monitor the parameter pattern of at least one of a RPM (Revolutions Per Minute), a horse power, a torque, fuel consumption, and an exhaust temperature of the prime mover, and/or a current drawn from a generator of the generator set.

Aspect 18. The transport refrigeration system of aspect 16-17, wherein the generator set includes a current meter configured to measure current drawn from the generator set.

With regard to the foregoing description, it is to be understood that changes may be made in detail, especially in matters of the construction materials employed and the shape, size and arrangement of the parts without departing from the scope of the present invention. It is intended that the specification and depicted embodiment to be considered exemplary only, with a true scope and spirit of the invention being indicated by the broad meaning of the claims.

What is claimed is:

1. A method to detect an operation condition of a compressor of a transport refrigeration system comprising:

obtaining an operation parameter of a generator set, wherein the generator set includes a prime mover that is configured to drive a generator that supplies power to the compressor;

determining an operation parameter pattern based on the operation parameter over a period of time;

determining whether the operation parameter pattern includes a periodic fluctuation of the operation parameter over the period of time, wherein the periodic fluctuation of the operation parameter is indicative of a periodical load/unload duty cycle of the compressor;

determining a first operation condition of the compressor when the operation parameter pattern lacks the periodic fluctuation of the operation parameter over the period of time;

determining a second operation condition of the compressor that is different from the first operation condition of the compressor when the operation parameter pattern includes the periodic fluctuation of the operation parameter over the period of time, wherein the second operation condition is when the compressor has the periodical load/unload duty cycle occurring when the transport refrigeration unit approaches or has reached a temperature setpoint; and adjusting a speed of the prime mover from a first speed to a second speed that is lower than the first speed when the second operation condition of the compressor is determined.

2. The method of claim 1, wherein the operation parameter of the generator set includes at least one of an RPM (Revolutions Per Minute), a horse power, a torque, fuel consumption, and an exhaust temperature of the prime mover.

3. The method of claim 1, wherein obtaining the operation parameter of the generator set includes obtaining the operation parameter of the generator set from an electronic control unit of the prime mover.

4. The method of claim 1 further comprising, controlling the prime mover of the generator set to operate at the first speed when determining the first operation condition of the compressor.

5. The method of claim 1, wherein the operation parameter is an RPM of the prime mover, and obtaining the operation parameter of the generator set including obtaining the RPM of the prime mover from an RPM sensor that is configured to monitor the RPM of the prime mover.

6. The method of claim 1, the operation parameter pattern includes the periodic fluctuation of the operation parameter over the period of time when the operation parameter pattern of the prime mover has a frequency similar to a periodical load/unload duty cycle of the compressor.

7. The method of claim 1, wherein the operation parameter of the generator set is an operation performance of the prime mover indicating how a load on the prime mover is impacting performance of the prime mover.

8. The method of claim 1, wherein the first operation condition is when the compressor does not have a periodical load/unload duty cycle which occurs when the transport refrigeration unit has not approached or reached a temperature setpoint.

9. The method of claim 1, wherein the compressor is a scroll compressor, and wherein the periodical load/unload duty cycle of the scroll compressor for each period includes continuously driving an orbiting scroll of the scroll compressor, and the orbiting scroll engaging a fixed scroll of the scroll compressor for a first amount of time and the orbiting scroll disengaging the fixed scroll for a second amount of time.

10. A method to control an operation of a prime mover of a transport refrigeration system comprising:

monitoring an operation parameter of a generator set, wherein the generator set is configured to supply power to a compressor of a transport refrigeration system, and wherein the generator set includes the prime mover coupled to a generator;

determining an operation parameter pattern based on the operation parameter over a period of time;

detecting whether the operation parameter pattern includes a periodic fluctuation of the operation parameter over the period of time, wherein the periodic fluctuation of the operation parameter is indicative of a periodical load/unload duty cycle of the compressor;

determining a first operation condition of the compressor when the periodic fluctuation is not detected;

determining a second operation condition of the compressor when the periodic fluctuation is detected;

operating the prime mover at a first operation speed when determining the first operation condition of the compressor; and operating the prime mover at the second operation speed that is lower than the first operation speed when determining the second operation condition of the compressor;

wherein the compressor is a scroll compressor and detecting whether the operation parameter pattern includes the periodic fluctuation includes determining whether the periodic fluctuation has a frequency of the periodical load/unload duty cycle of the scroll compressor.

11. The method of claim 10, wherein the prime mover is a two speed prime mover, and wherein the first operation speed of the prime mover is a high operation speed and the second operation speed is a low operation speed.

12. The method of claim 10, wherein the first operation condition indicates that the transport refrigeration system has not approached a temperature setpoint.

13. The method of claim 10, wherein the second operation condition indicates that the transport refrigeration system has approached a temperature setpoint.

14. The method of claim 10, wherein the operation parameter of the generator includes at least one of an RPM (Revolutions Per Minute), a horse power, a torque, fuel consumption, and an exhaust temperature of the prime mover.

15. The method of claim 10, wherein the periodical load/unload duty cycle of the scroll compressor for each period includes continuously driving an orbiting scroll of the scroll compressor, and the orbiting scroll engaging a fixed scroll of the scroll compressor for a first amount of time and the orbiting scroll disengaging the fixed scroll for a second amount of time.

16. A transport refrigeration system comprising:

a compressor;

a generator set configured to provide electrical power to the compressor; and a controller of the generator set configured to:

monitor an operation parameter of the generator set, determine an operation parameter pattern based on the operation parameter over a period of time, detect whether the operation parameter pattern includes a periodic fluctuation of the operation parameter over the period of time, wherein the periodic fluctuation of the operation parameter is indicative of a periodical load/unload duty cycle of the compressor, determine a first operation condition of the compressor when the periodic fluctuation is not detected, determine a second operation condition of the compressor when the periodic fluctuation is detected, operate a prime mover at a first operation speed when the controller determines the first operation condition of the compressor, and operate the prime mover at the second operation speed when the controller determines the second operation condition of the compressor;

wherein the compressor is a scroll compressor, and wherein the controller is configured to detect whether the operation parameter pattern includes the periodic fluctuation includes the controller being configured to determine whether the periodic fluctuation has a frequency of periodical load/unload duty cycle of the scroll compressor.

17. The transport refrigeration system of claim 16, wherein the generator set includes a prime mover and a generator, and the operation parameter includes at least one of an RPM (Revolutions Per Minute), a horse power, a torque, fuel consumption, and an exhaust temperature of the prime mover.

18. The transport refrigeration system of claim 16, wherein the generator set includes a current meter configured to measure current drawn from the generator set.

19. The transport refrigeration system of claim 16, wherein the first operation condition indicates that the transport refrigeration system has not approached a temperature setpoint, and the second operation condition indicates that the transport refrigeration system has approached a temperature setpoint.

20. The transport refrigeration system of claim 16, wherein the periodical load/unload duty cycle of the scroll compressor for each period includes continuously driving an orbiting scroll of the scroll compressor, and the orbiting scroll engaging a fixed scroll of the scroll compressor for a first amount of time and the orbiting scroll disengaging the fixed scroll for a second amount of time.

* * * * *